US006759995B1

(12) United States Patent
Speece

(10) Patent No.: US 6,759,995 B1
(45) Date of Patent: Jul. 6, 2004

(54) CONSTANT BEAMWIDTH HIGH GAIN BROADBAND ANTENNA

(75) Inventor: Daymond Roy Speece, San Jose, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/214,142

(22) Filed: Aug. 8, 2002

(51) Int. Cl.[7] ..... H01Q 15/14
(52) U.S. Cl. ..... 343/912; 343/915; 343/840
(58) Field of Search ..... 343/912, 915, 343/909, 840

(56) References Cited

U.S. PATENT DOCUMENTS 3,780,375 A * 12/1973 Cummings et al. ..... 343/915
4,021,816 A * 5/1977 Peck ..... 343/840
5,104,211 A * 4/1992 Schumacher et al. ..... 343/915
6,219,009 B1 * 4/2001 Shipley et al. ..... 343/915

* cited by examiner

*Primary Examiner*—Hoang V. Nguyen
(74) *Attorney, Agent, or Firm*—Townsend and Townsend and Crew LLP

(57) ABSTRACT

The present invention relates to reflective antennas. With previous antennas, the beamwidth of a reflected signal decreases linearly as the frequency of a transmitted signal increases. This is because the beamwidth for a normal antenna is a function of several parameters, including the frequency of the signal and the diameter of the reflective antenna. A beamwidth that decreases with frequency is undesirable because a decreased beamwidth results in a smaller user area on the ground. The present invention provides an antenna that maintains a constant beamwidth by using a mesh whose spacing increases with the distance from a central point.

17 Claims, 2 Drawing Sheets

CONSTANT BEAMWIDTH HIGH GAIN BROADBAND ANTENNA

BACKGROUND OF THE INVENTION

1. Field of the Invention

The present invention relates to reflective antennas. More specifically, the present invention relates to an antenna capable of limiting minimum reflective beamwidth at higher frequencies while maximizing antenna aperture at lower frequencies.

2. Background of the Invention

Communications systems are increasingly reliant on satellites to transmit, receive, and redirect signals. Today's satellites comprise a variety of materials and have a plurality of shapes and sizes. Satellite characteristics are typically based upon the requirements of a given application.

One type of antenna that is commonly used in space based applications is a parabolic antenna. Parabolic antennas are typically used to redirect a ground based signal either to another satellite or to another ground based receiving station. Parabolic antennas are typically used in applications where high gain is desired. However, these antennas can have other uses specifically suited for a given application.

One example of a parabolic antenna system is called Milstar. Milstar is an advanced military satellite communications system. The system comprises several satellites in geo-synchronous orbit. Each Milstar satellite serves as a switchboard in space by directing communications traffic from terminal to terminal anywhere on the Earth.

Several challenges exist for satellite systems such as Milstar. For example, maintaining the beamwidth of a signal from one ground station to another is a challenge currently facing system engineers. Typically, a beam containing information is transmitted to a space based satellite. A reflective antenna then sends the beam back to earth. Reflective antennas can have a many different shapes. Typically, however, a parabolic shape is used by those skilled in the art. With previous antennas, the beamwidth of a reflected signal decreases linearly as the frequency of a transmitted signal increases. This is because the beamwidth for a normal antenna is a function of several parameters, including the frequency of the signal and the diameter of the reflective antenna. A beamwidth that decreases with frequency is undesirable because a decreased beamwidth results in a smaller user area on the ground.

In order to avoid beamwidth decreases at higher frequencies, antennas must have smaller diameters as the frequency of a transmitted signal increases. This objective is tempered by the concurrent need to maintain large antenna apertures when transmitted signals are transmitted at lower frequencies. Many methods and apparatus have been employed to attempt to avoid beamwidth losses. The most common apparatus is an antenna with a horn feed. The horn beamwidth decreases as frequency increases, resulting in collection from a decreasing diameter of the reflective antenna. Alternatively, satellites have employed several reflective antennas with varying diameters. However, these methods are both costly and inefficient.

A continuing need exists for a reflective antenna that can preserve beamwidth at higher frequencies while maintaining antenna aperture at lower frequencies.

SUMMARY OF THE INVENTION

An object of the present invention is to provide an antenna formed by metallized mesh material with a mesh spacing that increases as the radius from the antenna center increases.

Still another object of the present invention is to use the increased mesh spacing to preserve a specified minimum bandwidth with increased frequency.

Yet another object of the present invention is to maintain antenna aperture at lower frequencies.

The present invention achieves the above and other objects by providing an antenna, comprising: a first set of conductors extending radially from a central point of the antenna; a second set of circular conductors; the first and second set of conductors being spaced about the central point of the antenna; and the spacing between adjacent ones of the circular conductors increasing with the distance from the central point.

Other and further objects of the present invention will be apparent from the following description and claims and are illustrated in the accompanying drawings, which by way of illustration, show a preferred embodiment of the present invention. Other embodiments of the invention embodying the same or equivalent principles may be used and structural changes may be made as desired by those skilled in art without departing from the present invention and the purview of the appended claims.

The details of the present invention, both as to its structure and operation can best be understood by referring to the accompanying drawings.

DETAILED DESCRIPTION OF THE DRAWINGS

Figure 1:
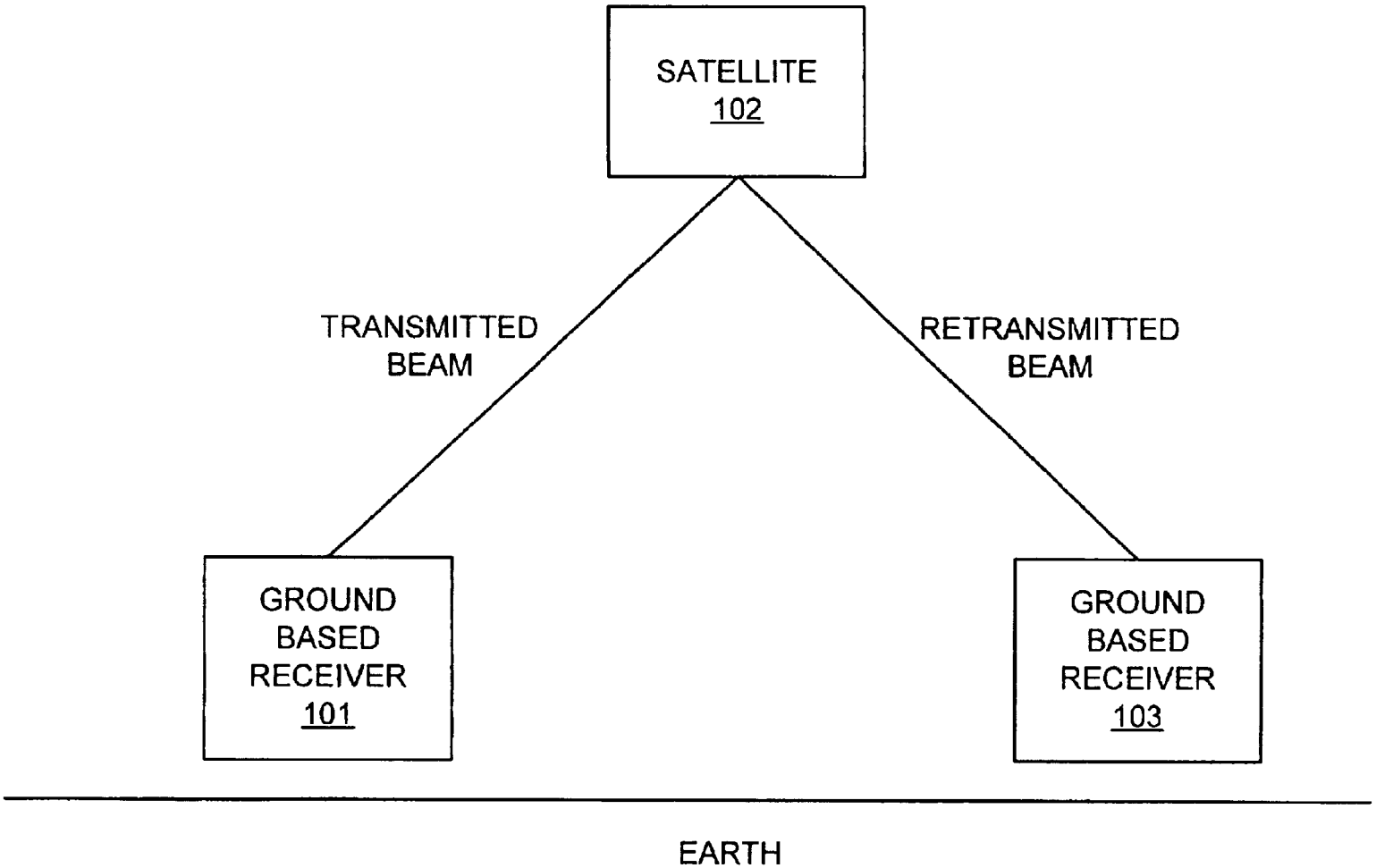
FIG. 1 is a block diagram showing an overview of an exemplary embodiment of the present invention.

FIG. 1 is a block diagram showing an overview of an exemplary embodiment of the present invention. Satellite networks are employed in order to reduce the cost and complexity of transmitting a signal from a ground based transmitter 101 to a ground based receiver 103. Erecting a terrestrial based network is complex and expensive. As a more practical alternative, satellites provide a cheaper and more convenient method for transmitting information. Typically, a beam containing information is transmitted from a ground based transmitter 101. The transmitted information contains data, along with instructions that tell a space based satellite 102 where to direct the beam. The satellite 102 then captures and retransmits the data beam towards the ground based receiver 103.

The orbit of a satellite around the earth can be described using several characteristics. For example, satellites can be classified according to the altitude of their orbit. These classifications include: Low Earth Orbit (LEO); Medium Earth Orbit (MEO); and High Earth Orbit (HEO). In the preferred embodiment of the present invention, satellites orbit the earth in a High Earth Orbit. The present invention can be applied to other orbits, and is not limited to a particular orbit. A satellite network can contain satellites in any orbit, or combination of orbits, according to a specific application. Additionally, satellites can be either geo-synchronous or asynchronous. A geo-synchronous satellite has a fixed position above the earth at all times. An asynchronously orbiting satellite orbits the earth at a speed that is either faster or slower than the rotational speed of the Earth. In the preferred embodiment of the present invention, geo-synchronous orbits are employed. The present invention can be applied to other obrits, and is not limited to a particular orbit.

Typically, reflective antennas have a parabolic shape. The parabolic shape is used because it has the property of reflecting all of the transmitted signal rays arriving along the antenna axis of symmetry to a common focus located to the front and center. The parabolic antenna's ability to amplify signals is primarily governed by the accuracy of this parabolic curve.

The parabolic shape of an antenna can vary in many respects. The first area of variation among circular aperture parabolic antennas is in the diameter. The diameter can vary from very small to very large, depending on the specific application. For example, in order to increase the gain of a parabolic antenna, the diameter of the parabolic shape should be increased. Conversely, decreasing the diameter of a parabolic antenna reduces its gain. However, the reduced diameter affords an increased user access area and susceptibility to noise interference. Those skilled in the art can determine the correct shape and size necessary to achieve a balance between increased user area and increased gains which is a well known design activity.

Figure 2:
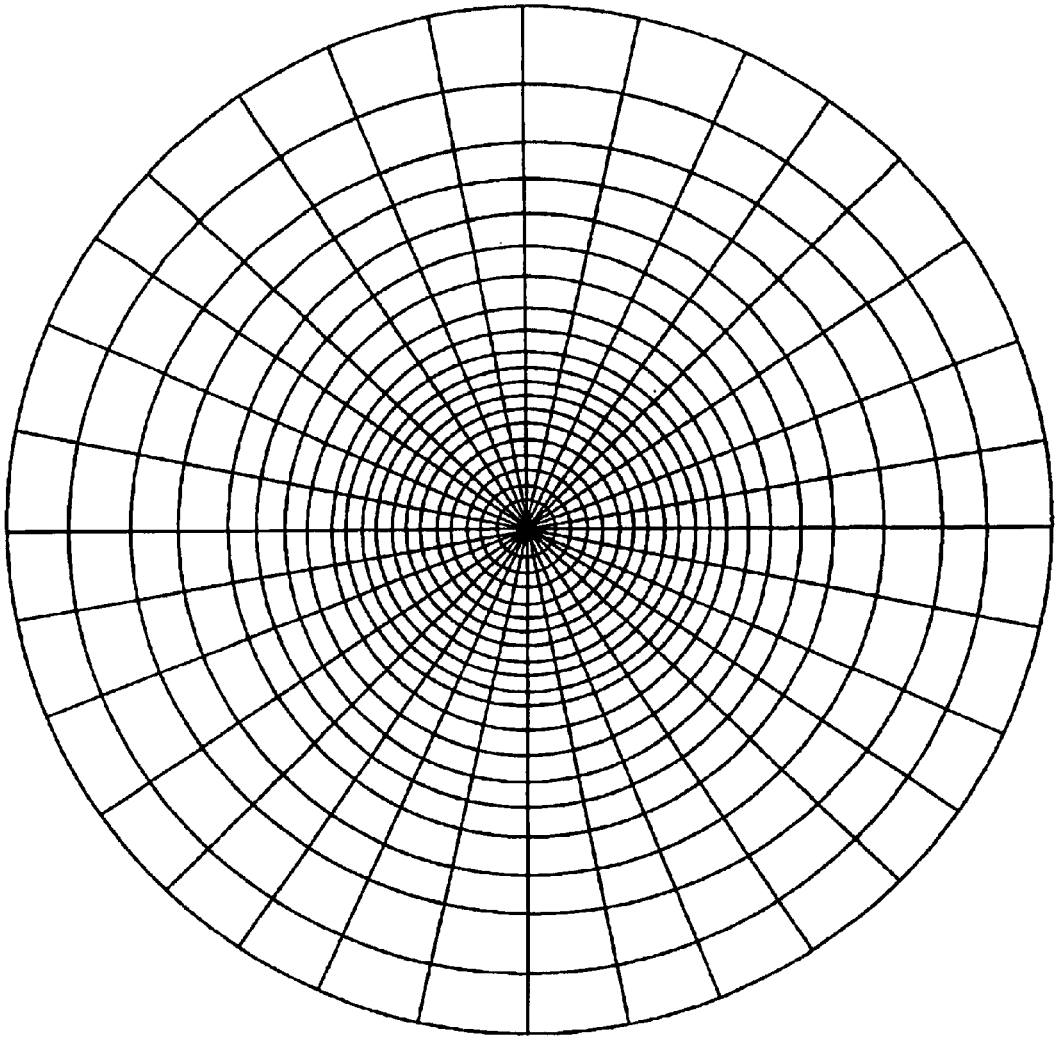
FIG. 2 is a diagram showing an exemplary antenna embodying the present invention.

The gain of an antenna is a measurement of its ability to amplify a signal transmitted from the ground station 101. Gain, which is expressed in decibels, or dB, is primarily a function of antenna frequency and capture area or aperture: the larger the antenna frequency or aperture, the higher the antenna gain and the narrower the beamwidth. The present invention is designed to achieve high gain, but can be modified to achieve other objectives such as low gain antennas FIG. 2 is a diagram showing the exemplary antenna embodying the present invention. Antennas are typically constructed out of a conductive material. Conductive materials are used in order to reflect the signal that is transmitted from a ground station 101. In the preferred embodiment of the present invention, a metallized mesh or screen comprising woven metallized thread is attached to a plurality of support members. The plurality of support members are typically referred to as ribs. The metallized mesh can be formed by two sets of conductors. Referring to FIG. 2, the first set of conductors 201 extend radially from a point that is preferably central to the antenna. The radial conductors 201 can be spaced at any interval, according to a specific application. A second set of conductors 202 form circles concentric with the central point of the antenna. The spacing between adjacent circular conductors increases with the distance from the central point of the antenna.

Parabolic antennas typically contain a solid central hub. However, a central hub is not required for the present invention. The metallized mesh or screen may begin at the central point of the antenna. If the antenna contains a central hub, the metallized mesh may begin at a radius corresponding with the end of the central hub. The ribs of an antenna typically serve to give the mesh conductors of an antenna a parabolic shape; but other shaping apparatus can be used, such as a backing or substrate. The parabolic shape of antenna becomes increasingly important for high frequency applications. The preferred embodiment of the present invention requires only as many ribs as are necessary to achieve a parabolic shape. The number of ribs may increase or decrease based on a given application.

The increasing mesh spacing of the exemplary embodiment of the present invention allows waves of certain frequencies to pass through the antenna, rather than to be reflected by it. This allows parts of the antenna to become electrically invisible. The antenna mesh is invisible if the spacing is larger than a wavelength at the transmitted frequency. This can be calculated according to the equation:

$$L=c/f$$

where f is the frequency of the transmitted signal, c is the speed of light, and L equals the wavelength. As f is increased, L decreases until a frequency is reached at which the mesh becomes invisible. Accordingly, as the frequency of the transmitted signal is increased, larger portions of the exemplary antenna become invisible.

Because of attitude control limits and/or a desired minimum ground footprint, it is sometimes desirable to limit the minimum antenna beamwidth at higher frequencies while maximizing gain at lower frequencies. As was previously discussed, at some specified frequency, the outer antenna circumference becomes electrically invisible. This invisible region increases as the frequency of the transmitted signal increases so that the effective antenna diameter shrinks.

Having the antenna diameter decrease as the frequency increases allows the beamwidth to remain constant. For example, for a typical parabolic antenna, the beamwidth can be calculated according to the equation:

$$B=K/(f\times D)$$

where K is a constant based on the antenna feed design, f represents the frequency of the transmitted signal, and D represents the diameter of the reflective antenna 102. K typically ranges between 60 and 70. In the formula, f is measured in GHz, and D is measured in feet. However, these values can change according to a specific application, and are not intended to limit the present invention. For example, if K=64, D=10 ft, and f=1 GHz, the bandwidth would be equal to 6.4 degrees. If the frequency was increased to f=2 GHz, the diameter D of the antenna would have to be reduced to 5 ft in order to maintain the beamwidth of 6.4 degrees. Typically, this is accomplished using additional smaller aperture antennas for each higher frequency range. However, the present invention uses just one antenna to limit the minimum beamwidth. The diameter D of the antenna is effectively reduced by limiting the electrically visible area of the antenna as the frequency of the transmitted signal increases. This maintains a constant beamwidth without requiring additional antennas or materials.

By maintaining a constant minimum beamwidth and maximizing antenna aperture at lower frequencies, the present invention aids in beam pointing. Typically, a satellite directs beams using an attitude control system. The attitude control mechanism must be increasingly precise as beamwidth decreases. This is because there is less room for error with narrow beams. However, by maintaining the minimum beamwidth of an antenna, the present invention allows the attitude control mechanism of a satellite to have a realizable margin of error.

In another embodiment of the present invention, an antenna is divided into a plurality of regions. Each region has conductive material with a given spacing. The spacing within a region can be uniform or non-uniform, depending on a given application. The spacing of the conductive material increases as the distance of the region from a given point increases. The given point can be any point on, above, or below the surface of the antenna, and can be determined according to a particular application. For example, in an illustrative embodiment, an antenna is divided into a plurality of regions using concentric circles. In the illustrative embodiment, a second region begins at the end of the previous one. This continues for each region that follows. In the illustrative embodiment, conductive material is positioned in each concentric circular region. The conductive material in each region has a given spacing.

For example, in one embodiment, the conductive material in the innermost region has a given spacing. The conductive material of the next region has a spacing that is larger than the spacing of the first region. This spacing of the conductive material continues to increase as the regions get farther away from the given point of the antenna.

The regions of the antenna do not have to be concentric circles. They can take any shape, for example, square, rectangular, or triangular. The shape of the region can be determined according to a particular embodiment. In another illustrative embodiment, a given region can comprise several smaller areas. However, in this illustrative embodiment, spacing of the conductive material in each smaller area is substantially similar throughout the given region. This could occur, for example, when regions have a rectangular shape spaced about the central point of the antenna. In this illustrative embodiment, each region can be divided into several smaller square or rectangular areas. Although each of the rectangular areas is at a different distance from the central point, they are all located within one region. For this reason, the conductive material of each of the smaller square or rectangular areas would have a substantially similar spacing.

In another illustrative embodiment of the present invention, metallization of selected parts of the antenna can be used to achieve increased spacing. For example, in one embodiment, an antenna can be comprised of a plurality of non-conductive material. In this exemplary embodiment, the non-conductive material can comprise a nylon mesh. Metallized conductive material is applied to the non-conductive material in a manner such that the spacing of the metallized material increases with the distance from a given point. In the exemplary embodiment, the given point is a central point of the antenna. However, this can be changed according to a particular application. In this embodiment, only the metallized conductive material will reflect a received signal. By selectively applying the metallized conductive material, a mesh with increased spacing can be achieved.

The metallized material is not intended to be limited to any type of pattern. For example, the metallized material can be applied to form a pattern substantially similar to the pattern described with reference to FIG. 2. However, other patterns can also be used as long as the mesh spacing increases with the distance from the given point. For example, metallization can be applied in a manner that forms a plurality of regions, as was described previously.

Although the invention has been described with reference to particular embodiments, it will be understood to those skilled in the art that the invention is capable of a variety of alternative embodiments within the spirit of the appended claims.

What is claimed is:

1. A antenna, comprising:

a first set of conductors extending radially from a central point of said antenna;

a second set of circular conductors;

said first and second set of conductors being spaced about said central point of said antenna; and said spacing between adjacent ones of said circular conductors increasing with the distance from said central point.

2. The antenna according to claim 1, wherein said antenna comprises a plurality of support members positioned to support said first and second set of conductors.

3. The antenna according to claim 2, wherein said antenna has a parabolic shape.

4. The antenna according to claim 3, wherein said plurality of support members comprise at least a number sufficient to maintain said parabolic shape.

5. The antenna according to claim 1, wherein said first and second set of conductors comprises woven metallized thread.

6. The antenna according to claim 1, wherein said antenna comprises a reflective antenna.

7. A reflective device, comprising:

a first set of conductors extending radially from a central point of said reflective device;

a second set of circular conductors;

said first and second set of conductors being spaced about said central point of said reflective device; and said spacing between adjacent ones of said circular conductors increasing with the distance from said central point.

8. The reflective device according to claim 7, wherein said reflective device comprises a plurality of support members positioned to support said first and second set of conductors.

9. The reflective device according to claims 8, wherein said reflective device has a parabolic shape.

10. The reflective device according to claim 9, wherein said plurality of support members comprise at least a number sufficient to maintain said parabolic shape.

11. The reflective device according to claim 7, wherein said first and second set of conductors comprise woven metallized thread.

12. An antenna, comprising:

a plurality of regions spaced about a given point of said antenna, conductive material positioned in said regions, said conductive material in each region having spacing, said spacing of said conductive material being dependent upon the distance of said region from said given point.

13. The antenna according to claim 12, wherein said spacing increases in accordance with one of:

uniformly within a region; and non-uniformly within a region.

14. The antenna according to claim 12, wherein said given point comprises a central point of said antenna.

15. The antenna according to claim 12, wherein said conductive material comprises woven metallized thread.

16. An antenna, comprising:

a plurality of metallized conductive material applied to a non-conductive surface, said metallized conductive material positioned about a given point of said antenna, said metallized conductive material having spacing, said spacing increasing with the distance from said given point.

17. The antenna according to claim 16, wherein said given point comprises a central point of said antenna.

* * * * *